US007532170B1

(12) United States Patent
Lee et al.

(10) Patent No.: US 7,532,170 B1
(45) Date of Patent: May 12, 2009

(54) CONFORMAL END-FIRE ARRAYS ON HIGH IMPEDANCE GROUND PLANE

(75) Inventors: Jar J. Lee, Irvine, CA (US); Stan W. Livingston, Fullerton, CA (US)

(73) Assignee: Raytheon Company, Waltham, MA (US)

( * ) Notice: Subject to any disclaimer, the term of this patent is extended or adjusted under 35 U.S.C. 154(b) by 1471 days.

(21) Appl. No.: 09/771,300

(22) Filed: Jan. 25, 2001

(51) Int. Cl.
*H01Q 1/28* (2006.01)
*H01Q 1/48* (2006.01)
*H01Q 15/14* (2006.01)

(52) U.S. Cl. ..... 343/705; 343/846; 343/912

(58) Field of Classification Search ..... 343/700 MS, 343/705, 767, 770, 850, 853, 793, 795
See application file for complete search history.

(56) References Cited

U.S. PATENT DOCUMENTS 4,853,704 A * 8/1989 Diaz et al. ..... 343/767
5,036,335 A * 7/1991 Jairam ..... 343/767
5,369,413 A * 11/1994 Hannan ..... 343/770
5,428,364 A 6/1995 Lee et al. ..... 343/767
5,648,786 A * 7/1997 Chung et al. ..... 343/770
5,894,288 A 4/1999 Lee et al. ..... 343/770
5,900,843 A 5/1999 Lee et al. ..... 343/767
5,923,302 A * 7/1999 Waterman et al. ..... 343/846
6,366,254 B1 * 4/2002 Sievenpiper et al. ..... 343/770

OTHER PUBLICATIONS

IEEE Transactions on Microwave Theory and Techniques, vol. 39, No. 4, Apr. 1991, Slotline Impedance by J.J. Lee, Senior Member, IEEE.
IEEE Transactionson Microwave Theory and Techniques, vol. 47, No. 11, Nov. 1999 High-Impedance Electromagnetic Surfaces With a Forbidden Frequency Band by Dan Sievenpiper, Member,IEEE, Lijun Zhang, Romulo F. Jimenez Broas, Nicholas G. Alexopolous, Fellow, IEEE, and Eli Yablonovitch,Fellow, IEEE.

* cited by examiner

*Primary Examiner*—Gregory C Issing
(74) *Attorney, Agent, or Firm*—Leonard A. Alkov

(57) ABSTRACT

A conformal end-fire antenna with a high impedance ground surface structure and an array of radiating elements formed thereon. The ground surface structure includes an array of metal protrusions on a electrically conductive sheet, the metal protrusions arranged in a two-dimensional lattice. The ground surface structure acts as a magnetic surface at an RF frequency band of interest, functioning as an electrical short at DC, and as a mirror which reflects an RF field in the frequency band with virtually no phase reversal.

10 Claims, 3 Drawing Sheets

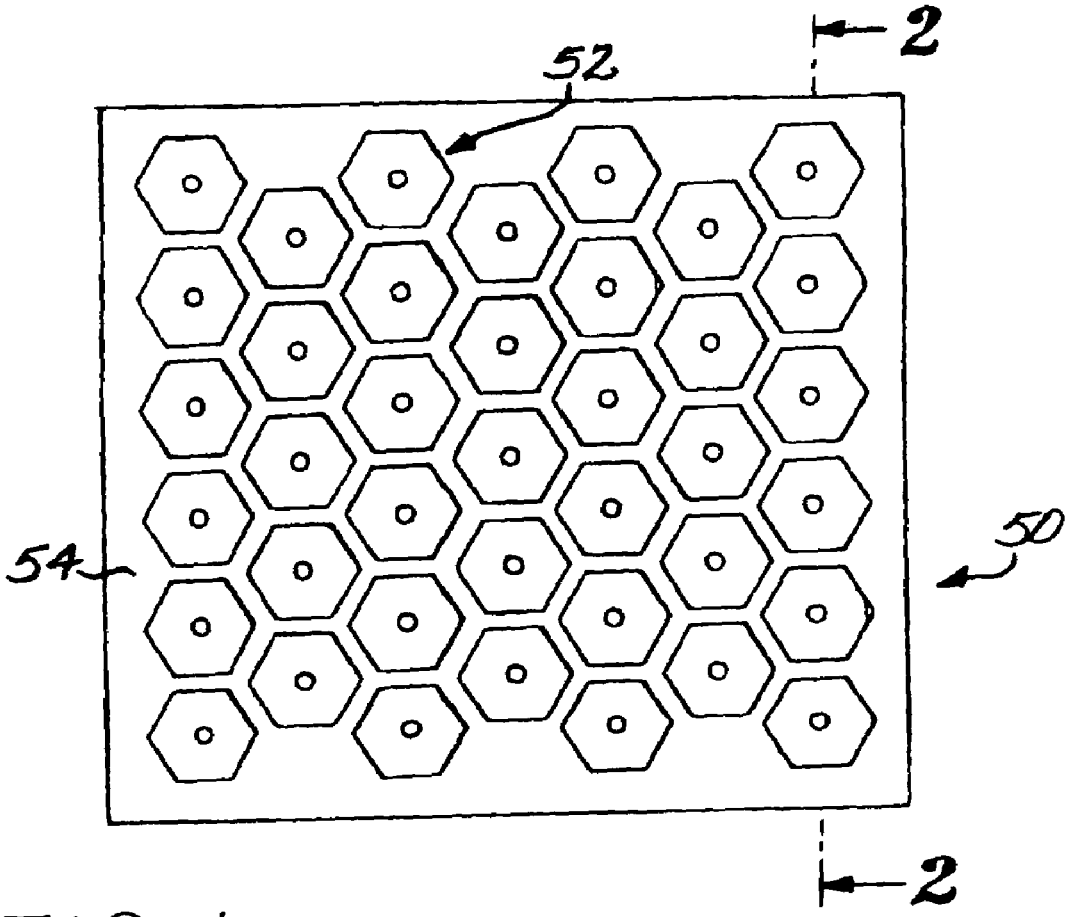
FIG. 1
(PRIOR ART)
FIG. 2 (PRIOR ART)
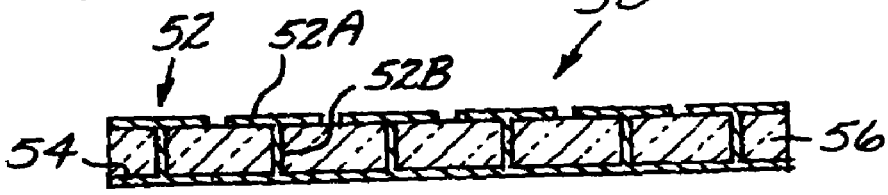

CONFORMAL END-FIRE ARRAYS ON HIGH IMPEDANCE GROUND PLANE

TECHNICAL FIELD OF THE INVENTION

This invention relates to RF antenna Systems, and more particularly to end-fire array systems.

BACKGROUND OF THE INVENTION

For certain applications, a flush-mounted end-fire antenna is required for an airborne or shipboard platform. For example, to combat low flying cruise missiles, a cylindrical UHF electronically scanned array is one of the most effective ways to detect, track, and classify these small targets with enough range to deploy necessary defenses. U.S. Pat. No. 5,874,915, the entire contents of which are incorporated herein by this reference, describes a robust antenna, which in an exemplary form is conformal to an E-2C radome with an oval cross section. In this exemplary form, the antenna is a non-rotating cylindrical wide band array controlled by a commutation switch matrix to provide 360 degree scan coverage, and includes two decks of radial columns of end-fire elements, with 48 columns on each deck. At any instant of time, for the exemplary antenna illustrated, only one third of the columns, a 120-degree sector, are excited to form a beam.

For some applications, it is highly desirable to have a forward-looking beam produced by an antenna flush to a metallic surface, e.g. a nose cone or a leading edge of a wing on a jet fighter, without short-circuiting of the tangential E-field of the radiating element by the metallic surface of the aircraft. Conventional patch or slot elements do not have end-fire gain in the direction close to the surface of a platform. A flared notch element, e.g. as illustrated in U.S. Pat. No. 5,428,364, can be designed to have a very high end-fire gain, but its E-field would be short-circuited by the image current induced on the ground plane when it is placed flat on a metal surface.

SUMMARY OF THE INVENTION

A conformal end-fire antenna is described, and includes a high impedance ground surface structure. The ground surface structures includes an array of metal protrusions on a metal sheet, the metal protrusions arranged in a two-dimensional lattice. An array of wide band flared notch radiating elements is fabricated on the surface structure.

Preferably, the ground surface structure is a magnetic surface at an RF frequency band of interest. The ground plane structure is an electrical short at DC, and functions as a mirror which reflects an RF field in the frequency band with virtually no phase reversal.

The protrusions form a thin layer of densely packed two-dimensional (2-D) periodic structure on top of the metal sheet, the periodic structure shielding the metal conducting surface underneath from inducing an image current to cancel the propagating E-field.

BRIEF DESCRIPTION OF THE DRAWING

These and other features and advantages of the present invention will become more apparent from the following detailed description of an exemplary embodiment thereof, as illustrated in the accompanying drawings, in which:

FIG. 1 is a top view of an exemplary ground plane structure employed in the invention.

FIG. 2 is a cross-sectional view taken along line 2-2 of FIG. 1.

DETAILED DESCRIPTION OF THE PREFERRED EMBODIMENTS

Figure 3:
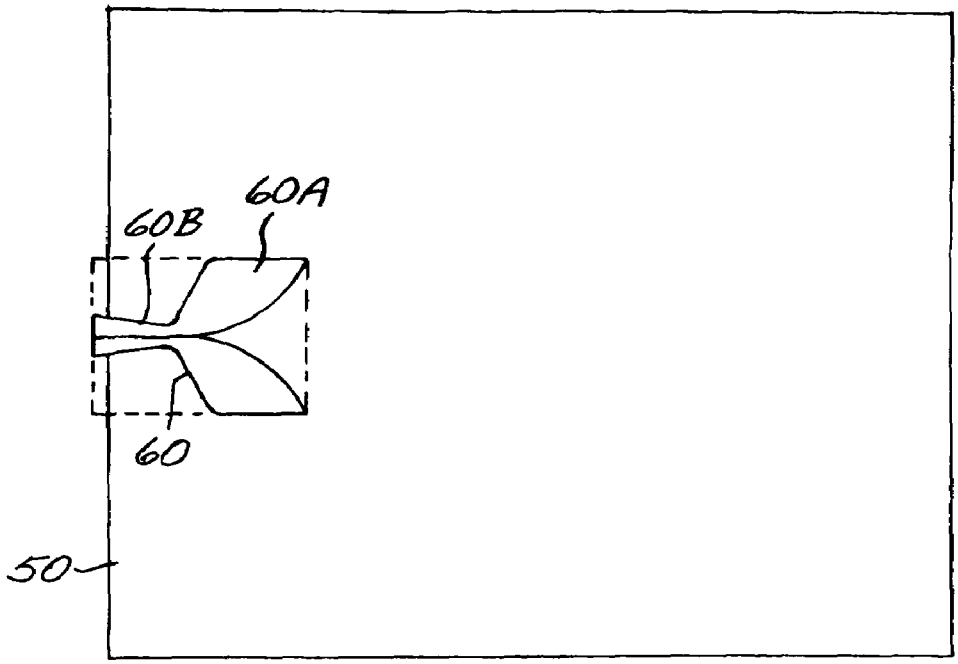
FIG. 3 illustrates a conformal end-fire array in accordance with the invention including a radiating element positioned on a ground plane structure as shown in FIGS. 1 and 2.

This invention takes advantage of a material described in "High Impedance Electromagnetic Surfaces with a Forbidden Frequency Band," Sievenpiper et al., IEEE Transactions on Microwave Theory and Techniques, Vol. 47, No. 11, November 1999, pages 2059-2074, the entire contents of which are incorporated herein by this reference. This new type of metallic EM structure is analogous to photonic crystals characterized by band gap properties. These are sometimes called PBG (Photonic Band Gap) materials. Although it is made of continuous metal, and conducts DC currents, it presents high impedance to electromagnetic (EM) waves in certain forbidden RF bands. Antenna elements on the high impedance ground plane structure tend to be isolated from each other, and also from the ground plane edge. Thus a finite ground plane appears to be infinite to the antenna. Also, it turns out that image currents on this ground plane flow in-phase, rather than out-of-phase with any antenna. This allows antennas to be nearly flush on the surface without being shorted out by the ground plane.

A high-impedance surface, shown in the top view of FIG. 1 and the cross-sectional view of respective FIGS. 1 and 2, includes any array of metal protrusions 52 extending from flat metal sheet 54. The metal protrusions 52 are arranged in a two-dimensional lattice, and are usually formed as metal plates 52A, connected to the continuous lower conductor 54 by vertical posts 52B. A low-loss dielectric substrate 56 is positioned between the continuous conductor 54 and the patches 52A.

In this exemplary embodiment, the protrusions 52 can be visualized as mushrooms or thumbtacks protruding from the surface 54. The metal plates or patches are in the form of hexagonal metal patches, although other shapes, e.g. square patches, can alternatively be employed. Preferably, the shapes of the patches provide fully packed structure, with only small open spaces between adjacent patches. There can even be multiple layers of patches, supported on high and on low posts. This allows the patches to trap charge.

The patches 52A and posts 52B can be sized using computer modeling techniques to compute the inductance/capacitance per unit cell. Commercially available software packages can be employed, e.g. Maxwell Eminence, and HFSS (High Frequency Structure Simulation) modeling software, marketed by Ansoft.

If the protrusions 52 are small compared to the wavelength, their electromagnetic properties can be described using lumped circuit elements, i.e. capacitors and inductors. The proximity of the neighboring metal elements provides the capacitance, and the long conducting path linking them together provides the inductance. The protrusions behave as parallel resonant LC circuits, which act as electric filters to block the flow of currents along the sheet.

In the frequency range where the surface impedance is very high, the tangential magnetic field is small, even with a large electric field. Such a structure is sometimes described as a "magnetic conductor," i.e. the dual of an electrical conductor.

Having high impedance and being nearly loss-less, since the ground plane structure can be made with a low-loss dielectric structure, this new surface illustrated in FIGS. 1 and 2 can be regarded as a kind of magnetic conductor over a certain frequency range. The ground plane structure is applicable to a variety of electromagnetic problems, including new kinds of low-profile antennas. High impedance ground plane structures offer the possibility of substantial weight and cost savings for aviation microwave components, while extending performance parameters beyond the current state-of-the-art.

The ground plane structure illustrated in FIGS. 1 and 2 is a magnetic surface as opposed to an electrical conductor at RF frequency bands of interest. Such a ground plane structure is a D.C. short, but it acts as a mirror which reflects an RF field with no phase reversal. This property results from the fact that the ground plane structure includes a very thin layer of densely packed two-dimensional (2-D) periodic structures on top of a conducting surface. The thin layer of the periodic structures acts as a "ground cover," which shields the conducting surface underneath from inducing an image current to cancel the propagating E-field.

A ground plane structure can be readily fabricated, starting with a dielectric substrate having formed on opposed surfaces a thin conductor layer. One conductor layer will serve as the conducting surface (54 in FIG. 1) underlying the layer of periodic structures. The opposite conductor layer is selectively etched to form the pattern of densely packed two dimensional structures or patches (52A in FIG. 1). The posts (52B, FIG. 1) connecting the two dimensional structures to the continuous conducting surface (54) can be fabricated by drilling holes through the patches and dielectric substrate to the lower conducting surface, and plating the holes with electrically conductive material.

FIG. 3 illustrates the concept of achieving a conformal end-fire array in accordance with the invention by printing the elements on a high impedance ground plane structure. A wide band flared notch radiating element 60 is placed adjacent a high impedance ground plane structure, which is designed to operate at S-band centered around 3 GHz. The radiating element includes flared wing portions included portion 60A, and a balanced feed section, such as a twin lead transmission line section 60B. The radiating element in an exemplary embodiment is of the type described in U.S. Pat. No. 5,428,364, the entire contents of which are incorporated herein by this reference. The radiating element comprises electrically conductive flared notch patterns formed on both sides of a thin substrate layer. To prevent dc grounding, a thin gap is maintained between the adjacent surface of the radiating element and the high impedance ground plane structure. The gap can be filled by a thin layer of a dielectric material such as MYLAR™, say 1/16 inch to 1/4 inch in thickness. The gap is no more than a few percent of a wavelength. The antenna pattern in the H-plane (i.e. elevation plane in the vertical direction normal to the circuit board) was measured for an exemplary embodiment. The test was repeated with the radiating element placed on a regular metallic ground plane. The results demonstrated that a regular ground plane deflects the main beam from the ground plane by 60 degrees, while the high impedance ground plane structure shifts the beam down by 30 degrees, resulting in a 20 dB improvement in directivity in the end-fire direction.

Figure 4:
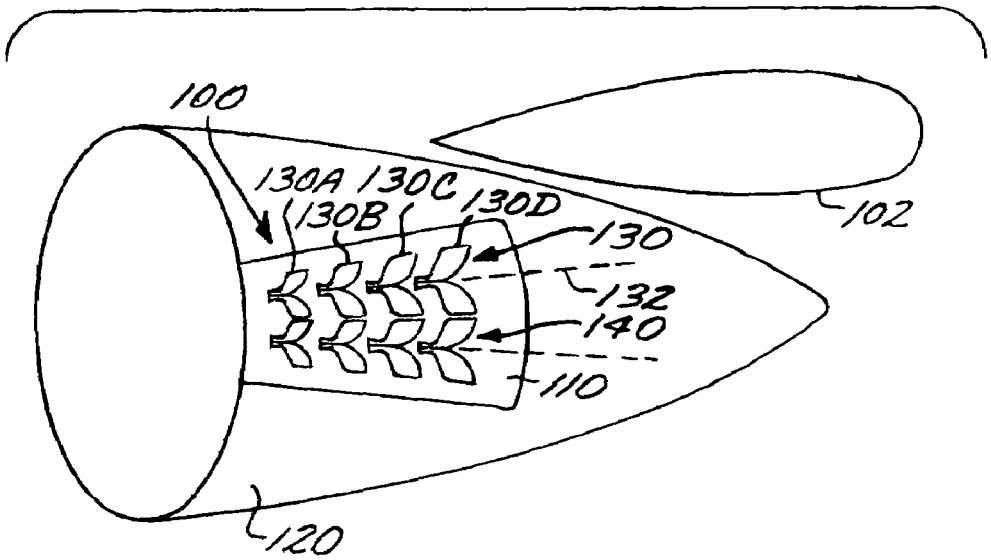
FIG. 4 illustrates a conformal array printed on a ground plane structure attached to a nose cone of an aircraft or airborne missile to produce a forward-looking beam.

A further embodiment of the invention is shown in FIG. 4, where a conformal array 100 is printed on a patch 110 of high impedance ground plane structure attached to a nose cone 120 of an aircraft or airborne missile to produce a forward-looking beam indicated generally at 102. The nose cone 120 is preferably fabricated of a dielectric material. The patch 110 conforms to the curved surface of the nose cone. The conformal array 100 is a wide-band end-fire array of the type described in U.S. Pat. No. 5,894,288, the entire contents of which are incorporated herein by this reference. A feed arrangement similar to that disclosed in FIG. 7 of this patent can be employed to feed the array 100.

The radiating elements comprising the array 100 each include a pair of flared dipole wing portions which form a balanced circuit, and a balanced feed section, such as a twin lead transmission line section. Thus, in this exemplary embodiment, as illustrated in FIG. 4, array 100 includes two array sections 130, 140, each of which includes a plurality of radiating elements arranged end-to-end along a common end-fire axis and spaced apart along the axis by a separation distance, each element comprising a flared notch radiating element. Array section 130, for example, includes four radiating elements 130A, 130B, 130C and 130D arranged along axis 132. The spacing distance for this embodiment is one-quarter wavelength at band center.

Figure 5:
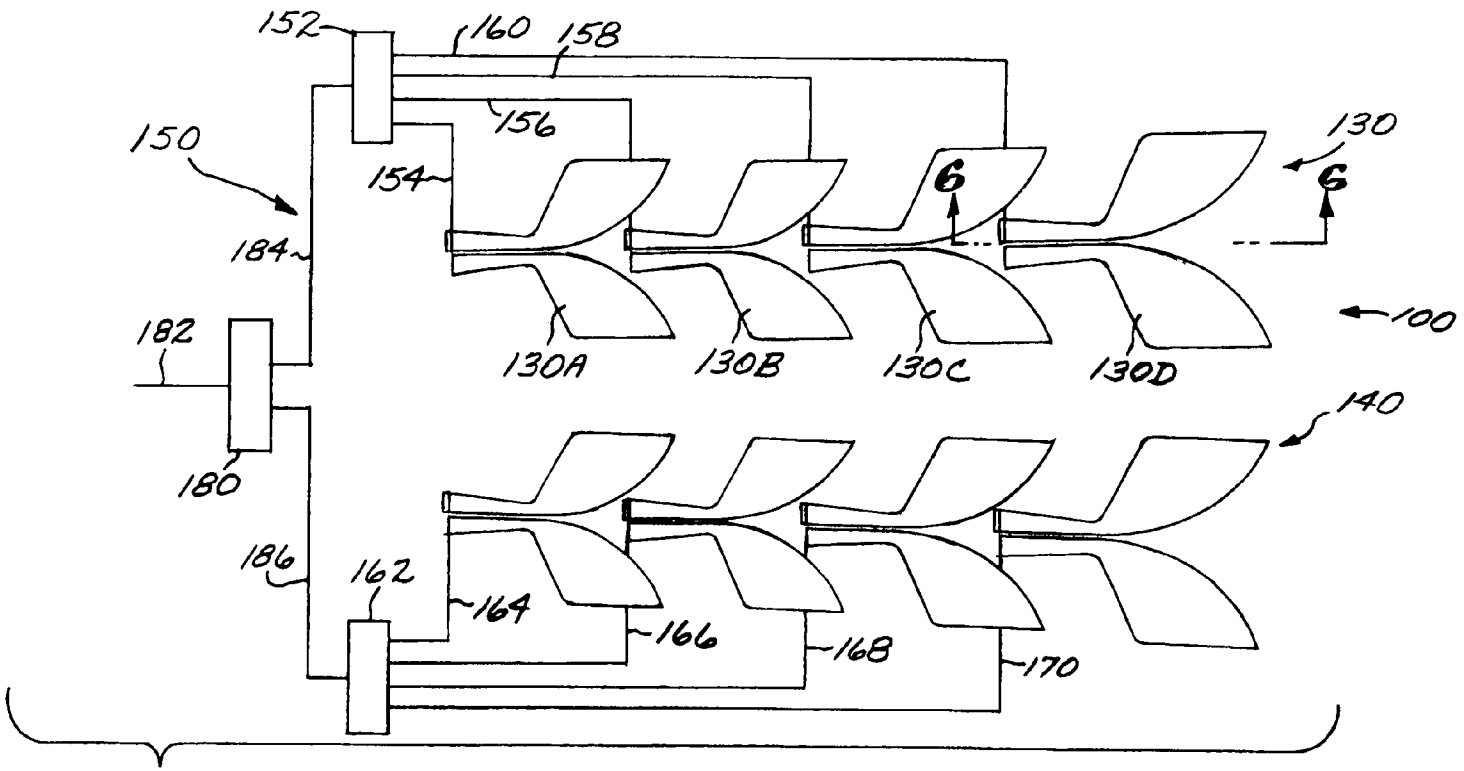
FIG. 5 is a schematic diagram illustrating an exemplary beam forming network for feeding the radiating elements comprising the array of FIG. 4.

FIG. 5 is a schematic diagram illustrating an exemplary beam forming network 150 for feeding the radiating elements comprising the array 100. The network includes a 2:1 combiner/divider 180 for either dividing an input signal received on line 182 into two signals on lines 184, 186, or combining the signals on lines 184, 186 into a combined signal on line 182. The network 150 further includes for each array section 130, 140 a 4:1 combiner/divider 152, 162. The combiner/divider 152 has a port connected to line 184, and ports connected to transmission lines 154, 156, 158, 160, e.g. coaxial transmission lines, which are connected to the balanced feed section for the respective radiating elements 130A-130D. Thus, the combiner/divider 152 can either divide a signal on line 184 into four drive signals, on transmit, for the respective radiating elements 130A-130D, or combine received signals on lines 154-160, on receive into a combined signal for line 184. The lengths of lines 154-160 are selected to provide a true-time-delay network so that the signals on receive can be combined coherently, or so that the signals on transmit coherently form a beam in the forward direction.

Figure 6:
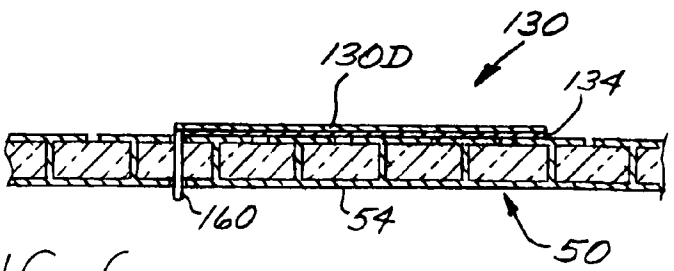
FIG. 6 is a cross-sectional view taken along line 6-6 of FIG. 5.

FIG. 6 is a cross-sectional view taken along line 6-6 of FIG. 5, and shows the manner in which the exemplary radiating element 130D is positioned on the ground plane structure 50. The radiating elements, including element 130D, are fabricated on a thin dielectric substrate 134. The flared dipole wings portions and balanced feed sections of the radiating elements are defined in a pattern formed in a thin conductive layer formed on the top surface of the substrate 134. The lower surface of the substrate 134 is positioned on the high impedance ground plane structure 50. The radiating element 130D includes a balanced feed section, such as a twin lead transmission line section, as described in U.S. Pat. No. 5,428,364 and in "Slotline Impedance," J. J. Lee, IEEE Transactions on Microwave Theory and Techniques, Volume 39, No. 4, April 1991, pages 666-672. The transmission line 160 connected to the combiner/divider 152 is connected to the balanced feed section for the radiating element, through a right angle coaxial feed-through in the high impedance ground plane structure. Thus, the feed network 150 is positioned within the nose cone 120 in this exemplary embodiment. Alternatively, the flared notch dipole wing portions and twin lead feed portions of the radiating elements can be formed on both surfaces of the dielectric substrate, with a thin dielectric layer positioned between the radiating element structure and the high impedance ground plane structure.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A conformal end-fire antenna, comprising:

a high impedance ground surface structure, comprising an array of metal protrusions formed as metal plates connected to metal sheets by vertical posts, the metal protrusions arranged in a two-dimensional lattice, wherein the high impedance ground surface structure is a magnetic conductor surface at an RF frequency band of interest, said ground surface structure functioning as a D.C. short and as a mirror which reflects an RF field in said frequency band with virtually no phase reversal;

an array of wide band flared notch radiating elements positioned adjacent the ground surface structure, said array of radiating elements comprising a plurality of radiating elements arranged end-to-end along a common end-fire axis and spaced apart along the axis by separation distance wherein a thin gap filled by a thin layer of dielectric material is maintained between a surface of each of the radiating elements and the high impedance ground surface structure; and a true-time-delay corporate feed network connected to the radiating elements, wherein time delay differences in contributions by the individual radiating elements to a composite array signal due to the separation of the elements along the axis are equalized by the true-time delay corporate feed network, wherein the true-time-delay corporate feed network includes a plurality of combiner/dividers and a plurality of coaxial transmission lines, wherein the lengths of coaxial transmission lines of the corporate feed network provide a true-time-delay network so that signals on receive are combined coherently and the signals on transmit coherently form a beam in the forward direction.

2. The antenna of claim 1, wherein the protrusions form a very thin layer of a densely packed two-dimensional (2-D) periodic structure on top of a conducting surface, the periodic structure shielding the conducting surface underneath from inducing an image current to cancel the propagating E-field.

3. The antenna of claim 1, wherein the metal plates have a hexagonal shape.

4. The array of claim 1 wherein the radiating elements are spaced along the axis by one-quarter wavelength at a center frequency of operation for the array, and the array provides an end-fire beam in only one direction along the axis.

5. The array of claim 1 wherein each flared notch radiating element includes a pair of flared dipole wings.

6. The array of claim 5 wherein the flared dipole wings of each radiating element are fabricated on a top surface of a dielectric substrate, and a lower surface of the dielectric substrate is adjacent the ground surface structure.

7. A conformal end-fire antenna for mounting on a nose cone of an aerial vehicle, comprising:

a high impedance ground surface structure, including an array of metal protrusions formed as metal plates connected to electrically conductive sheets by vertical posts, the contour of the sheets conforming to the surface contour of the nose cone, the metal protrusions arranged in a two-dimensional lattice, wherein the high impedance ground surface structure is a magnetic conductor surface at an RF frequency band of interest, said ground surface structure functioning as a D.C. short and as a mirror which reflects an RF field in said frequency band with virtually no phase reversal;

an array of wide band flared notch radiating elements positioned adjacent the ground surface structure, said array conforming to said contour, wherein said array comprises a plurality of radiating elements arranged end-to-to end along a common end-fire axis and spaced apart along the axis by a separation distance, each element comprising a flared notch radiating element wherein a thin gap filled by a thin layer of dielectric material is maintained between a surface of each of the radiating elements and the high impedance ground surface structure; and a beam-forming network connected to the radiating elements wherein the beam-forming network includes a true-time-delay network, wherein time delay differences in contributions by the individual radiating elements to a composite array signal due to the separation of the elements along the axis are equalized by the true-time-delay network, wherein the true-time-delay network includes a plurality of combiner/dividers and a plurality of coaxial transmission lines and wherein the lengths of the coaxial transmission lines of the feed network provide a true-time-delay network so that the signals on receive are combined coherently and that the signals on transmit coherently form a beam in the forward direction, and wherein the radiating elements are spaced along the axis by one-quarter wavelength at a center frequency of operation for the array, and the array provides an end-fire beam in only one direction along the axis.

8. The antenna of claim 7 wherein each flared notch radiating element includes a pair of flared dipole wings.

9. The antenna of claim 8 wherein the flared dipole wings of each radiating element are fabricated on a top surface of a dielectric substrate, and a lower surface of the dielectric substrate is adjacent the ground surface structure.

10. The antenna of claim 7, wherein the protrusions form a very thin layer of densely packed two-dimensional (2-D) periodic structure on top of a conducting surface, the periodic structure shielding the conducting surface underneath from inducing an image current to cancel the propagating E-field.

* * * * *